US009928813B1

(12) United States Patent
Washburn

(10) Patent No.: US 9,928,813 B1
(45) Date of Patent: Mar. 27, 2018

(54) ROLLABLE AND ADJUSTABLE MUTE FOR BRASS INSTRUMENTS

(71) Applicant: Andrew M. Washburn, Gastonia, NC (US)

(72) Inventor: Andrew M. Washburn, Gastonia, NC (US)

( * ) Notice: Subject to any disclaimer, the term of this patent is extended or adjusted under 35 U.S.C. 154(b) by 0 days.

(21) Appl. No.: 15/633,706

(22) Filed: Jun. 26, 2017

(51) Int. Cl.
*G10D 9/06* (2006.01)
*G10D 9/00* (2006.01)

(52) U.S. Cl.
CPC ..... *G10D 9/06* (2013.01); *G10D 9/00* (2013.01)

(58) Field of Classification Search
CPC ..... G10D 9/06
USPC ..... 84/400
See application file for complete search history.

(56) References Cited

U.S. PATENT DOCUMENTS 1,369,370 A * 2/1921 Ward ..... G10D 9/06 84/400
1,671,818 A * 5/1928 English ..... G10D 9/06 84/400
2,248,352 A * 7/1941 Humes ..... G10D 9/06 84/400
2,252,847 A * 8/1941 Greenspan ..... G10D 9/06 84/400
2,470,597 A * 5/1949 Woodward ..... G10D 9/06 181/258
2,501,388 A * 3/1950 Holland ..... G10D 9/00 84/400
2,574,591 A * 11/1951 Rudd ..... G10D 9/06 84/400
2,621,553 A * 12/1952 Daoust ..... G10D 9/06 84/400
2,807,182 A * 9/1957 Briggs ..... G10D 9/06 84/400
3,016,782 A * 1/1962 Laas ..... G10D 9/00 84/400
3,299,764 A * 1/1967 Ventura ..... G10D 9/06 84/400
3,392,619 A * 7/1968 Hill ..... G10D 9/06 84/400
3,429,215 A * 2/1969 Finch ..... G10D 9/06 84/400
3,720,970 A * 3/1973 Lutz ..... A43D 3/1416 12/114.6

(Continued)

FOREIGN PATENT DOCUMENTS

GB 679158 A * 9/1952 ..... G10D 9/06
GB 728992 A * 4/1955 ..... G10D 9/06

*Primary Examiner* — David Warren
*Assistant Examiner* — Christina Schreiber
(74) *Attorney, Agent, or Firm* — Jeffrey Watson; Mathew L. Grell; Grell & Watson Patent Attorneys LLC

(57) ABSTRACT

A mute for a brass instrument includes a body and a locking mechanism. The body includes a sheet of rollable material configured to roll into a cone shaped mute. The locking mechanism is configured to lock the rolled sheet of rollable material as the cone shaped mute. The mute may be transported or stored in a flat form of the body. The body has a substantially semi-circle shape when flat that is configured to roll into the cone shaped mute. The substantially semi-circle shape of the body has an outer diameter when flat configured to create an open end of the cone shaped mute when rolled into the cone shaped mute. The open end of the cone shaped mute is sized to match a rim of a bell of the brass instrument.

19 Claims, 10 Drawing Sheets

(56) References Cited

U.S. PATENT DOCUMENTS

| | | | | | |
|---|---|---|---|---|---|
| 4,012,983 | A * | 3/1977 | Ploeger | G10D 9/00 | 181/155 |
| D259,426 | S * | 6/1981 | Baldwin | D17/13 | |
| 4,548,026 | A * | 10/1985 | Shidner | A01K 13/007 | 168/2 |
| 4,998,959 | A * | 3/1991 | Purdie | G10D 9/06 | 84/400 |
| 5,309,808 | A * | 5/1994 | Tarrant | G10D 9/06 | 181/131 |
| 5,373,771 | A * | 12/1994 | Weik | G10D 9/06 | 181/191 |
| 5,569,864 | A * | 10/1996 | Hamanaga | G10D 9/06 | 84/400 |
| 5,780,757 | A * | 7/1998 | Valtchev | G10D 9/00 | 84/380 R |
| 5,920,022 | A * | 7/1999 | Ashwood, Jr. | G10G 7/00 | 219/201 |
| 7,049,501 | B2 * | 5/2006 | Shellhammer | G10D 9/06 | 181/233 |
| 7,658,016 | B2 * | 2/2010 | Schulkin | A47G 25/20 | 223/85 |
| 7,871,374 | B2 * | 1/2011 | De Canniere | A61B 17/0293 | 600/208 |
| 8,269,087 | B1 * | 9/2012 | Davis | G10D 9/06 | 84/400 |
| 2004/0261602 | A1 * | 12/2004 | Shellhammer | G10D 9/06 | 84/400 |
| 2009/0013852 | A1 * | 1/2009 | Perry | G10D 9/00 | 84/453 |
| 2014/0373698 | A1 * | 12/2014 | Suenaga | G10D 9/06 | 84/400 |

* cited by examiner

ROLLABLE AND ADJUSTABLE MUTE FOR BRASS INSTRUMENTS

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE DISCLOSURE

Technical Field of the Disclosure

The instant disclosure generally relates to music instruments, namely brass music instruments, like the trumpet/cornet, the French horn, the trombone, the baritone/euphonium, and the tuba/sousaphone. More particularly, the instant disclosure relates to a rollable and adjustable mute for brass instruments.

Description of the Related Art

A brass instrument is a musical instrument that produces sound by sympathetic vibration of air in a tubular resonator in sympathy with the vibration of the player's lips. Brass instruments are also called labrosones, literally meaning "lip-vibrated instruments". There are several factors involved in producing different pitches on a brass instrument. Slides, valves, crooks, or keys are used to change vibratory length of tubing, thus changing the available harmonic series, while the player's embouchure, lip tension and air flow serve to select the specific harmonic produced from the available series. The term 'brass instrument' is typically defined by the way the sound is made, as above, and not by whether the instrument is made of brass. Thus, one finds brass instruments made of wood, like the alphorn, the cornett, the serpent and the didgeridoo, while some woodwind instruments are made of brass, like the saxophone.

A mute is a device fitted to a musical instrument to alter the sound produced: by affecting the tone (also known as timbre), reducing the volume, or most commonly both. The use of a mute is usually indicated in musical notation by the Italian direction con sordino and removed with the senza sordino direction, which means "without mute".

A variety of mutes have been used on brass instruments, most of which either squeeze inside the bell of the instrument, or are held, hung, or clipped to the outside of the bell. The most common type is the straight mute, a hollow, cone-shaped mute that fits into the bell of the instrument. The second most common brass mute is the cup mute. There are a range of other mutes for brass instruments, such as the solotone mute, the buzz-wah mute, the Wah-wah mute, bucket mutes, and hats or plungers.

Mutes for brass instruments have long been used for a variety of purposes; volume control, change of tonal color, and special musical effects. As such, whether by musician preference or the type of sound required or desired to be played, many musicians use a variety of different mutes for different sounds and music. As such, the instant disclosure recognizes the fact that musicians may be required to buy and transport multiple mutes for different sounds.

Another problem with the aforementioned traditional mutes is that of size, shape and transportability, as none of these fit readily into a standard instrument case. Thus, there is clearly a need to provide a mute that is easier to transport and/or store, like by readily fitting into a standard instrument case.

The instant disclosure is designed to address at least some aspects of the problems discussed above. The mute described herein may be designed to replace three common mutes, like the cup mute, the bucket mute, and the plunger mute, and may also be usable as an acoustic baffle when unrolled or unfolded flat. The mute described herein may also solve the storage and/or transportation issue by being designed to unroll or fold flat for storage and/or transportation.

SUMMARY

Briefly described, in a possibly preferred embodiment, the present disclosure overcomes the above-mentioned disadvantages and meets the recognized need for such a device by providing a rollable and adjustable mute for a brass instrument. The mute as disclosed herein may be adjusted and used as three traditional mutes for brass instruments: the cup mute, the bucket mute, and the plunger mute. By combining these functions, the mute is more versatile and convenient. Further enhancing the convenient nature of the invention, the mute disclosed herein may unfold into a flat state where it may be easily transported or stored, and used as an acoustic baffle.

In one aspect, the rollable and adjustable mute described herein may generally include a body and a locking mechanism. The body includes a sheet of rollable material configured to roll into a cone shaped mute. The locking mechanism is configured to lock the rolled sheet of rollable material as the cone shaped mute. The mute may be transported or stored in a flat form of the body. The body has a substantially semi-circle shape when flat that is configured to roll into the cone shaped mute. The substantially semi-circle shape of the body has an outer diameter when flat configured to create an open end of the cone shaped mute when rolled into the cone shaped mute. The open end of the cone shaped mute is sized to match a rim of a bell of the brass instrument. The mute may be used on any brass instruments or the like, including, but not limited to: a trumpet or a cornet; a French horn, a trombone, a baritone or a euphonium, a tuba or a sousaphone, the like, and/or combinations thereof.

One feature of the rollable and adjustable mute described herein, may be that in select embodiments the substantially semi-circle shape of the body may have a side with a cut-out. The cut-out may be positioned approximate a middle of the side. The cut-out may have an inner diameter when flat configured to make an opening at a pointed end of the cone shaped mute when rolled into the cone shaped mute.

Another feature of the rollable and adjustable mute described herein, may be that in select embodiments the substantially semi-circle shape of the body may have a side with a top edge and a bottom edge. The top edge may be configured to overlap with the bottom edge for creating the cone shaped mute. In select embodiments, the top edge may be angled from the bottom edge.

In select embodiments of the rollable and adjustable mute for brass instruments described herein, the locking mechanism may include a top connector and a bottom connector. The top connector may be positioned approximate the top edge. The bottom connector may be positioned approximate the bottom edge. Wherein, when the body is rolled into the cone shaped mute and the top edge overlaps the bottom edge, the top connector and the bottom connector may be configured to lock together for securing the body as the cone shaped mute.

In select embodiments of the locking mechanism, the top connector and the bottom connector may comprise snap connections. In these embodiments, the top connector may comprise two top snap connections positioned and spaced apart along the top edge, and the bottom connector may comprise two corresponding bottom snap connections positioned and spaced apart along the bottom edge. Wherein, when the body is rolled into the cone shaped mute and the top edge overlaps the bottom edge, the two snap connections of the top connector and the two corresponding snap connections of the bottom connector may be configured to lock together for securing the body as the cone shaped mute.

In other select embodiments of the locking mechanism, the top connector and the bottom connector may comprise hook and loop type fasteners. In these embodiments, the top connector may comprise two hook or loop strips positioned and spaced apart along and perpendicular to the top edge, and the bottom connector may comprise two corresponding hook or loop strips positioned and spaced apart along and perpendicular to the bottom edge. Wherein, when the body is rolled into the cone shaped mute and the top edge overlaps the bottom edge, the two hook or loop strips of the top connector and the two corresponding hook or loop strips of the bottom connector may be configured to lock together for securing the body as the cone shaped mute.

Another feature of the rollable and adjustable mute for brass instruments described herein may be the inclusion of at least one attachment arm. The attachment arm or arms may be configured to hang the open end of the cone shaped mute from the rim of the bell of the brass instrument for use as a bucket mute or as a cup mute. Each of the at least one attachment arms may include at least one protrusion for hanging the open end of the cone shaped mute from the rim of the bell of the brass instrument. In select embodiments, the mute may include two attachment arms spaced apart along the top portion of the open end of the cone shaped mute.

Another feature of the rollable and adjustable mute for brass instruments described herein may be the inclusion of an adjustment arm. The adjustment arm may be configured to adjust space between the rim of the bell and the open end of the cone shaped mute. The adjustment arm may comprise a plurality of slots configured to receive the rim of the bell of the brass instrument. Whereby, the space between the rim of the bell and the open end of the cone shaped mute may be adjusted by placing the rim of the bell in the plurality of slots.

In select embodiments of the rollable and adjustable mute for brass instruments described herein, the attachment arms may comprise two protrusions, and the adjustment arm may comprise four slots. In this embodiment, the cone shaped mute may provide eight muting positions.

Another feature of the rollable and adjustable mute for brass instruments described herein may be that the at least one attachment arm and the adjustment arm may be rotatable. This feature may allow the attachment arm(s) and the adjustment arm to rotate for recessing the at least one attachment arm and the adjustment arm inside the cone shaped mute. With the attachment arm(s) and the adjustment arm positioned inside the cone shaped mute, the mute may be used as a plunger mute.

Another feature of the rollable and adjustable mute for brass instruments described herein may be that the body may be positioned flat for use as an acoustic baffle for a brass instrument.

Another feature of the rollable and adjustable mute for brass instruments described herein may be the inclusion of at least one vent. Each of the at least one vents may be an eyelet hole in the sheet of rollable material. In select example embodiments, the at least one vent may include: two eyelet holes positioned approximately vertical with one another in the sheet of rollable material; two eyelet holes positioned approximately horizontal with one another in the sheet of rollable material; three eyelet holes positioned offset with one another in the sheet of rollable material; or five eyelet holes positioned offset with one another in the sheet of rollable material.

In another aspect, the mute for a brass instrument described herein may include the at least one attachment arm and the adjustment arm. The at least one attachment arm may be configured to hang an open end of the mute from a rim of a bell of the brass instrument for use as a bucket mute or as a cup mute. Each of the at least one attachment arms may include two protrusions for hanging an open end of the mute from the rim of the bell of the brass instrument at two positions. The adjustment arm may comprise four slots configured to receive the rim of the bell of the brass instrument. Whereby, the space between the bell and the open end of the mute may be adjusted in four positions by placing the rim of the bell in the four slots. The combination of the at least one attachment arm with two protrusions and the adjustment arm with four slots may provide eight muting positions for the mute.

In select embodiments, the at least one attachment arm and the adjustment arm may be rotatable for recessing the at least one attachment arm and the adjustment arm inside the mute for use as a plunger mute.

In another aspect, the mute for a brass instrument described herein may include the at least one attachment arm and the adjustment arm. The at least one attachment arm may be configured to hang an open end of the mute from a rim of a bell of the brass instrument for use as a bucket mute or as a cup mute. The adjustment arm may comprise at least one slot configured to receive the rim of the bell of the brass instrument. Whereby, the space between the bell and the open end of the mute may be set by placing the rim of the bell in the at least one slot. Wherein, the at least one attachment arm and the adjustment arm may be rotatable for recessing the at least one attachment arm and the adjustment arm inside the mute for use as a plunger mute.

These and other features of the rollable and adjustable mute for brass instruments will become more apparent to one skilled in the art from the prior Summary, and following Brief Description of the Drawings, Detailed Description, and Claims when read in light of the accompanying Detailed Drawings.

BRIEF DESCRIPTION OF THE DRAWINGS

The present apparatuses, systems and methods will be better understood by reading the Detailed Description with reference to the accompanying drawings, which are not necessarily drawn to scale, and in which like reference numerals denote similar structure and refer to like elements throughout, and in which.

Figure 1:
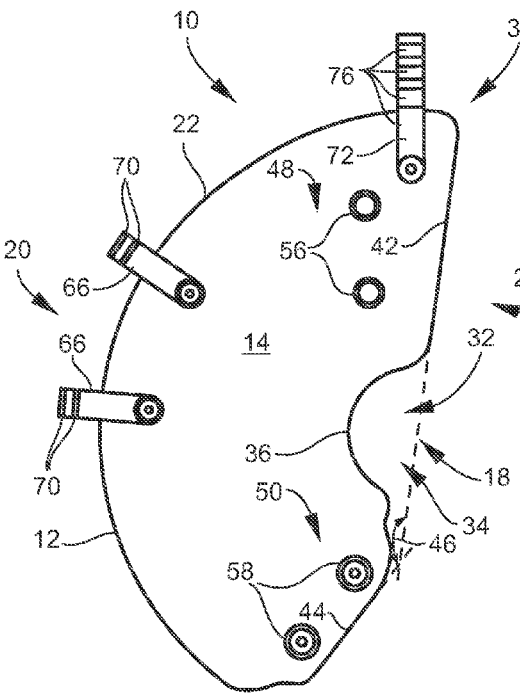
FIG. 1 is a top plane view of the instant rollable and adjustable mute for brass instruments according to one embodiment in a flattened or unrolled form with the attachment and adjustment arms extended outwards and snap locking mechanisms.
Figure 2:
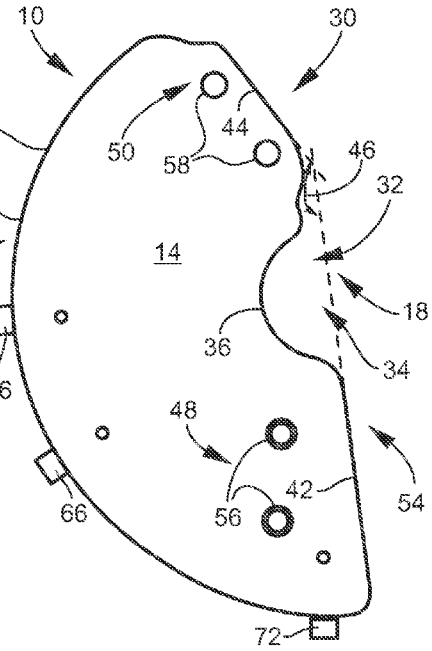
FIG. 2 is a bottom plane view of the mute from FIG. 1.
Figure 3:
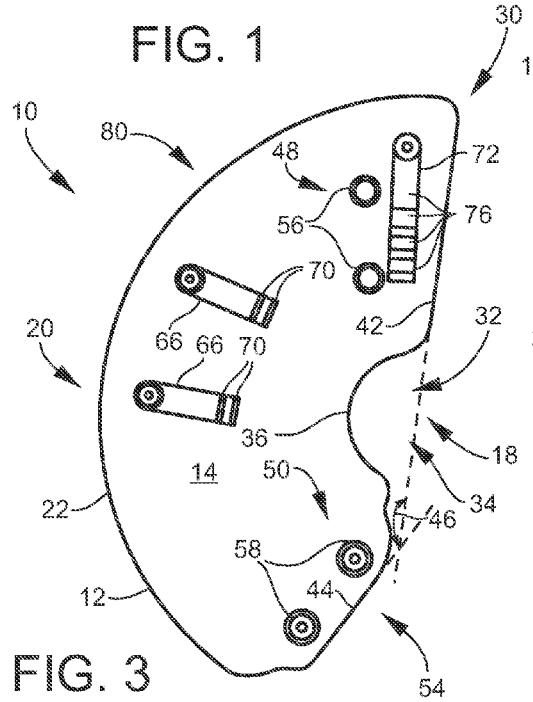
FIG. 3 is a top plane view of the mute from FIG. 1 with the attachment and adjustment arms rotated inwards.
Figure 4:
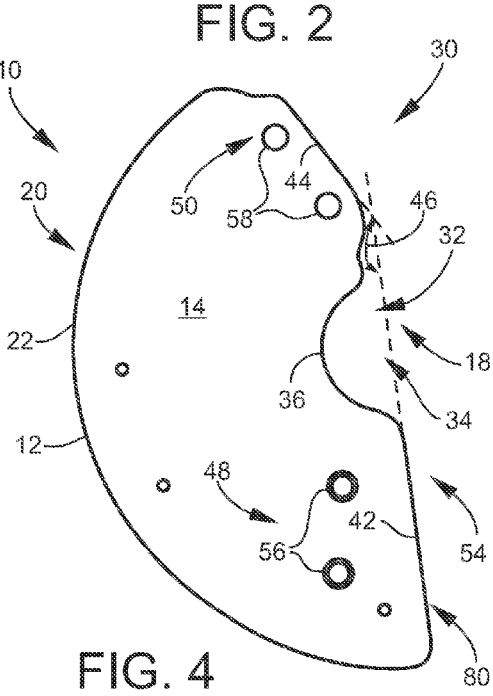
FIG. 4 is a bottom plane view of the mute from FIG. 3.
Figure 5:
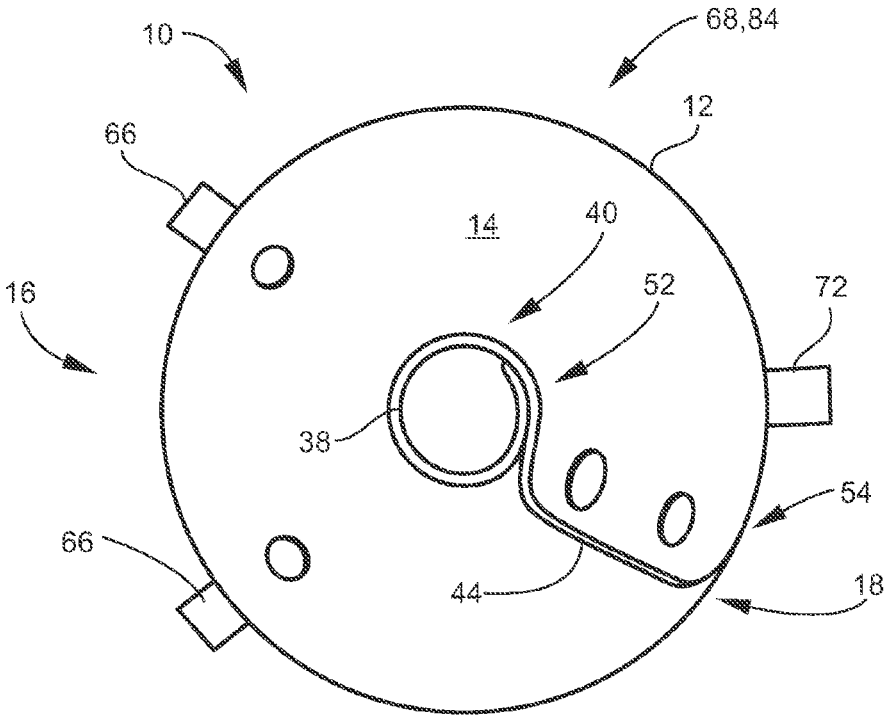
FIG. 5 is a front plane view of the mute from FIG. 1 locked in a cone or rolled form with the attachment and adjustment arms extended outwards.
Figure 6:
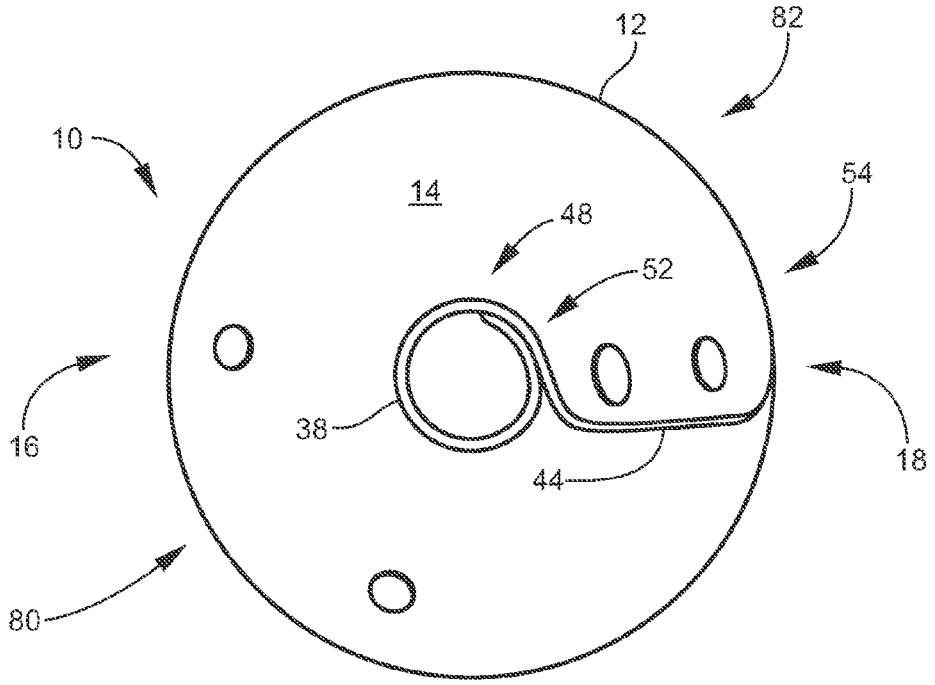
FIG. 6 is a front plane view of the mute from FIG. 5 with the attachment and adjustment arms rotated and recessed inwards.
Figure 7:
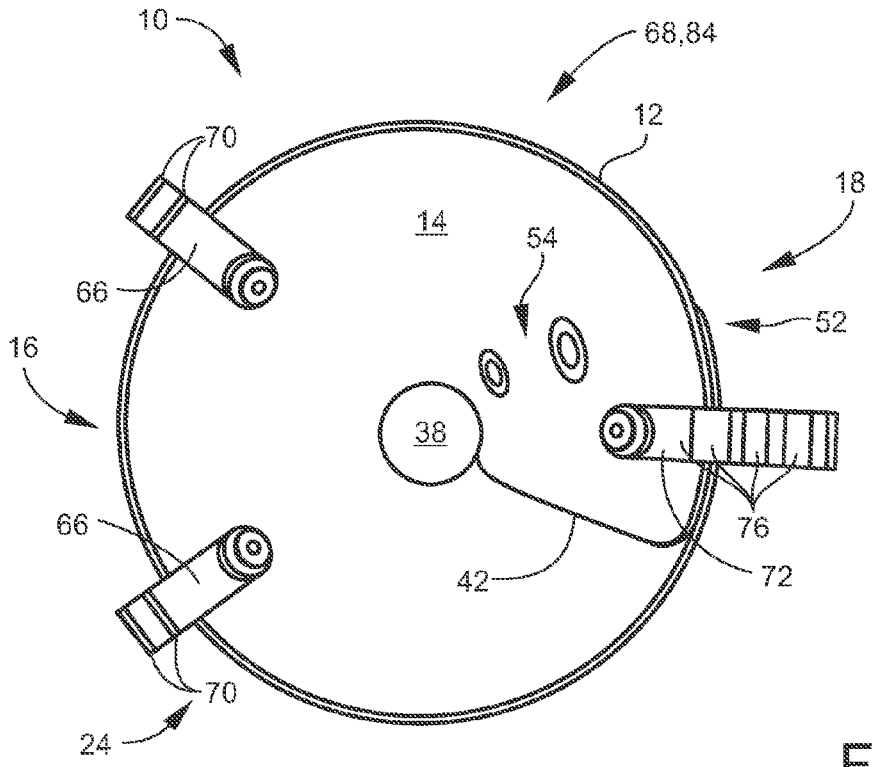
FIG. 7 is a rear plane view of the mute from FIG. 5.
Figure 8:
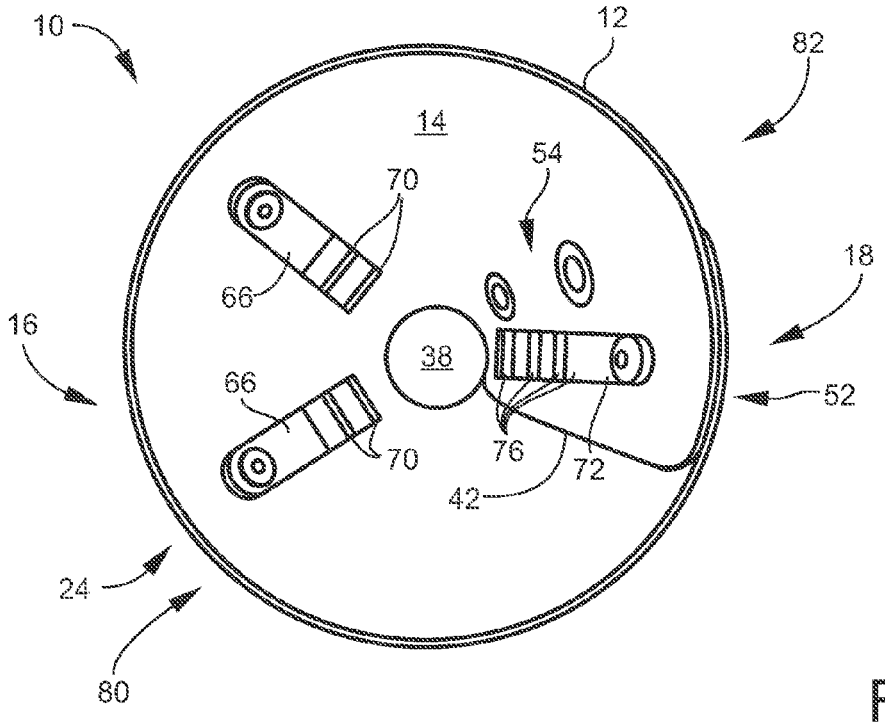
FIG. 8 is a rear plane view of the mute from FIG. 6.
Figure 9:
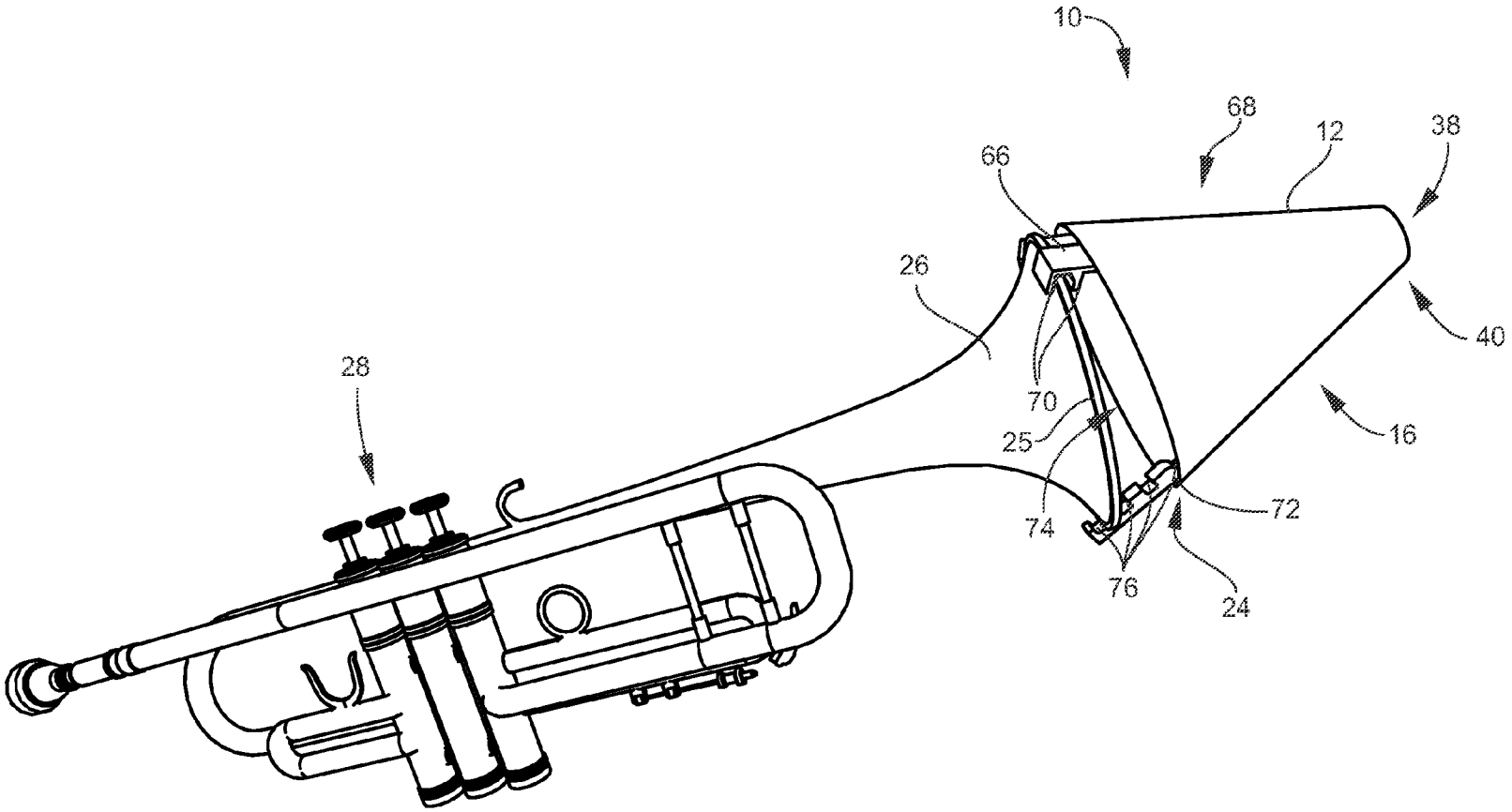
FIG. 9 is a perspective view of the mute from FIG. 5 attached to the rim of the bell of a brass instrument.
Figure 11:
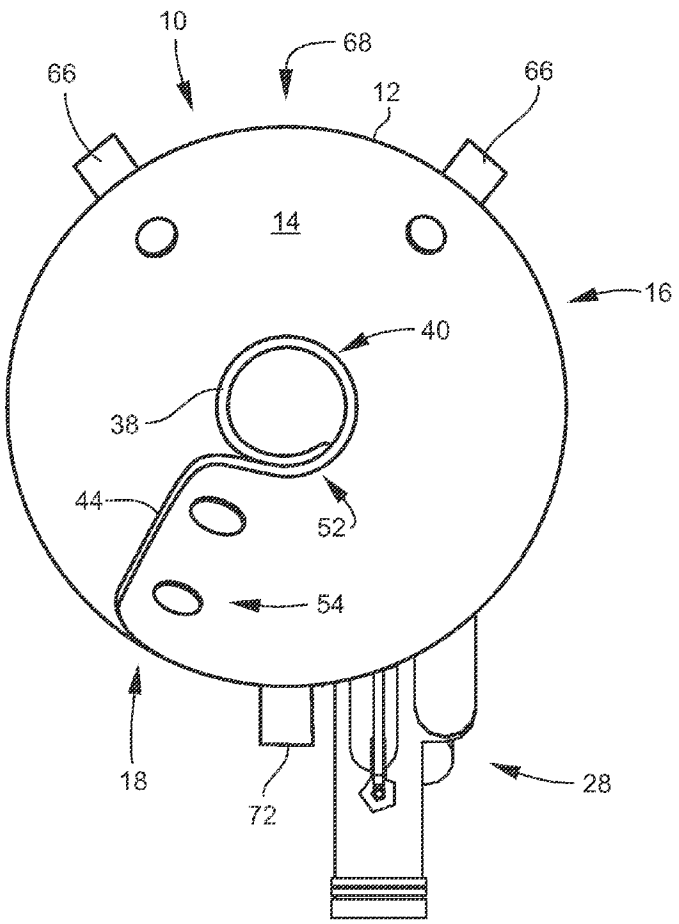
FIG. 11 is a front view of the mute and brass instrument from FIG. 9.
Figure 10:
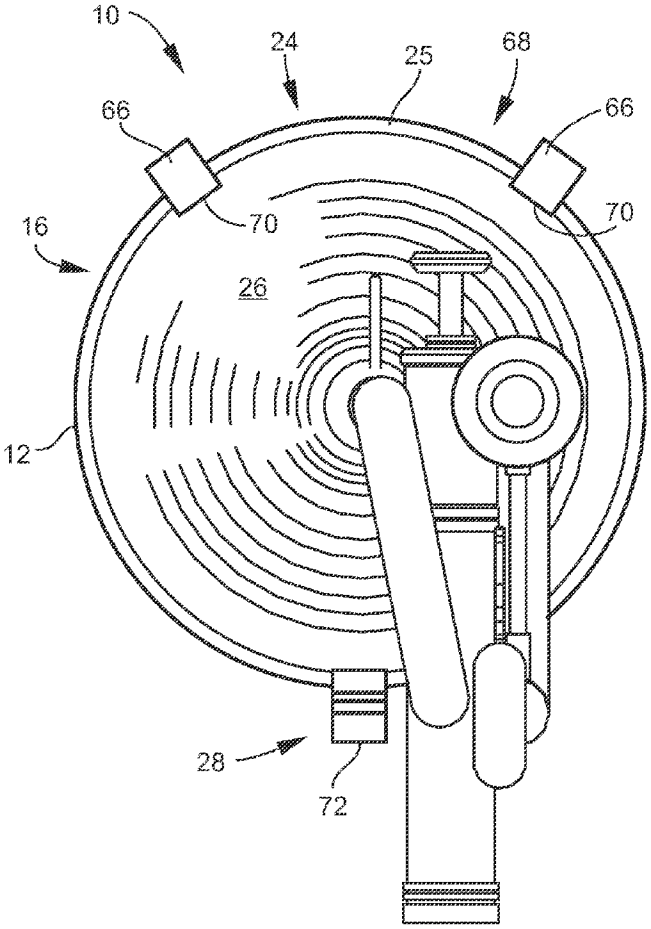
FIG. 10 is a rear view of the mute and brass instrument from FIG. 9.
Figure 12A:
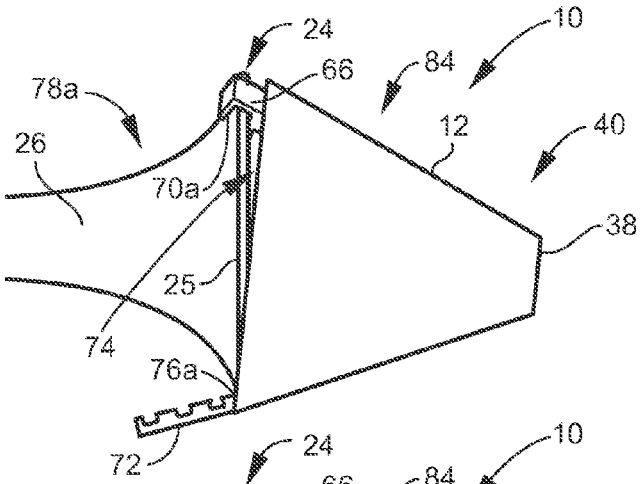
FIGS. 12*a*, 12*b*, 12*c* and 12*d* are side plane views of the mute from FIG. 5 with the first protrusion of the attachment arms hung from the rim of the bell, and the adjustment arm positioned on the rim of the bell in the first lower slot (FIG. 12*a*), the second lower slot (FIG. 12*b*), the third lower slot (FIG. 12*c*), and the forth lower slot (FIG. 12*d*)
Figure 12B:
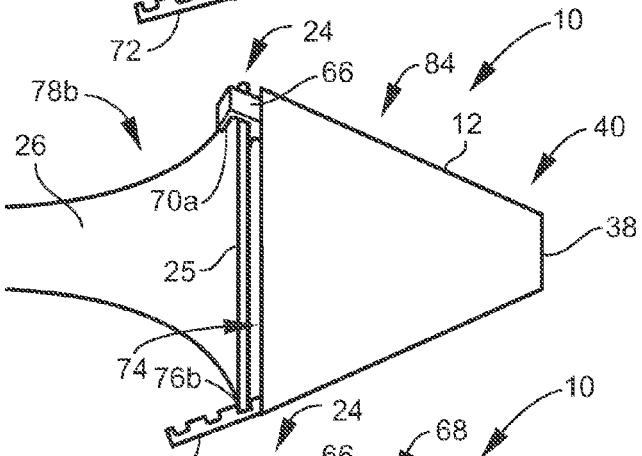
Figure 12C:
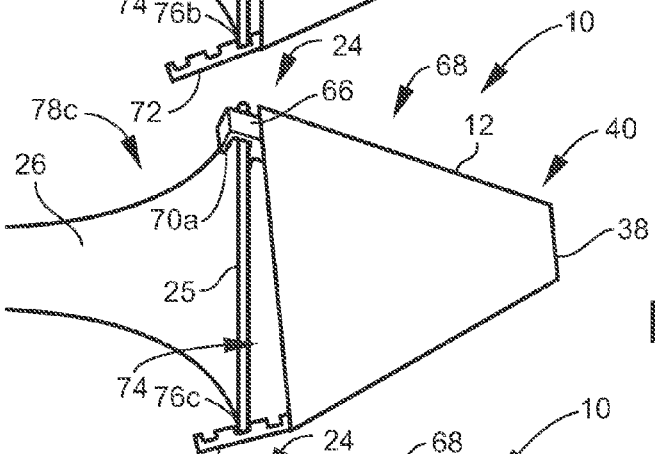
Figure 12D:
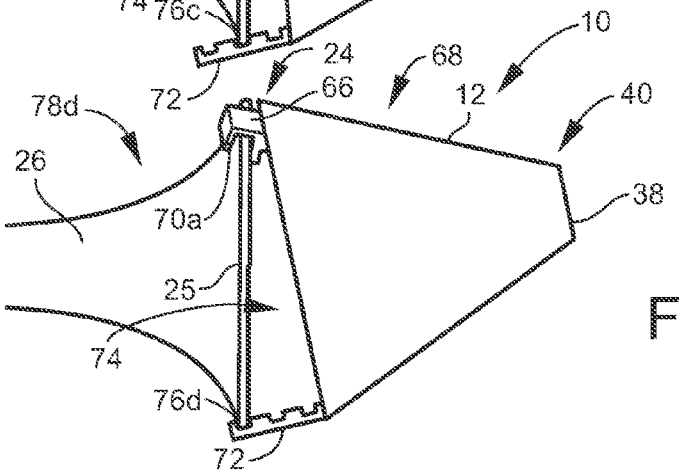
Figure 13A:
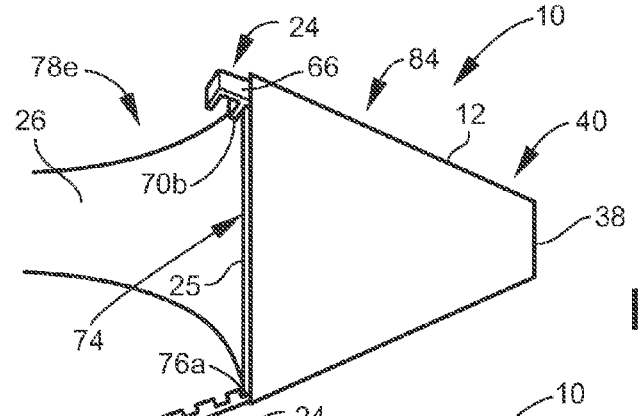
FIGS. 13*a*, 13*b*, 13*c* and 13*d* are side plane views of the mute from FIG. 5 with the second protrusion of the attachment arms hung from the rim of the bell, and the adjustment arm positioned in the first lower slot (FIG. 13*a*), the second lower slot (FIG. 13*b*), the third lower slot (FIG. 13*c*), and the forth lower slot (FIG. 13*d*)
Figure 13B:
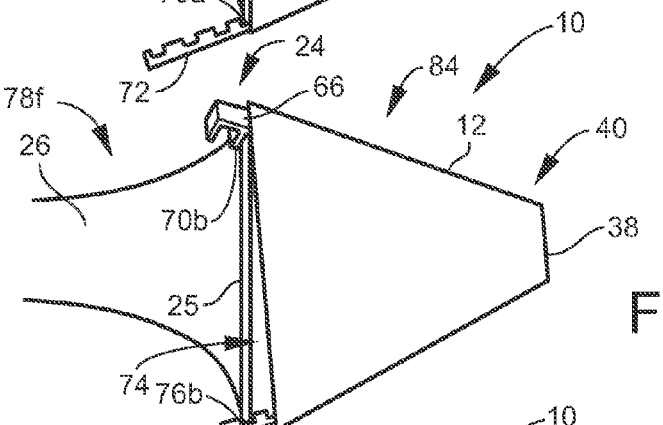
Figure 13C:
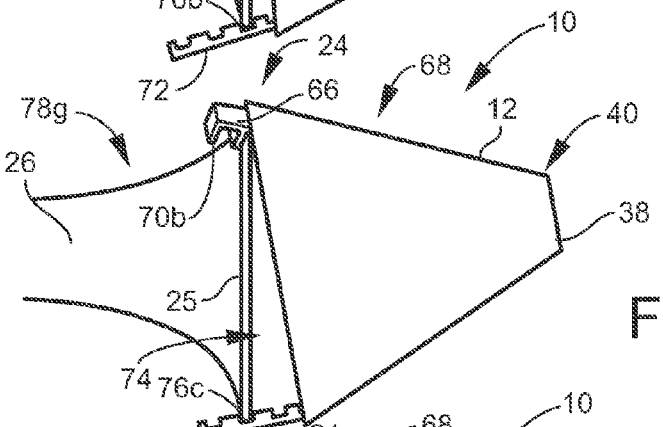
Figure 13D:
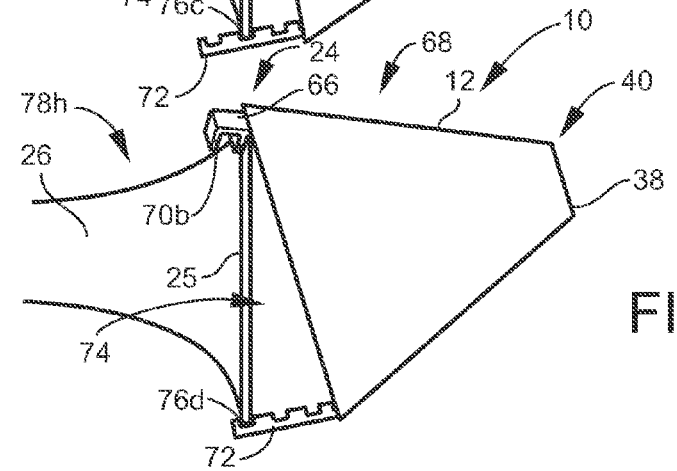

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1-19, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-19 by way of example, and not limitation, therein is illustrated example embodiments of rollable and adjustable mute 10. Rollable and adjustable mute 10 may be referred herein as just mute 10. Mute 10 may be used on brass instrument 28. Although brass instrument 28 is shown in the drawings as a trumpet, the disclosure is not so limited, and mute 10 may be used on any brass instrument or the like, including, but not limited to: a trumpet or a cornet; a French horn, a trombone, a baritone or a euphonium, a tuba or a sousaphone, the like, and/or combinations thereof.

In one aspect, mute 10 may provide the functions of three traditional mutes for brass instruments: a cup mute 68 (see FIGS. 5, 7, 12*c*, 12*d*, 13*c*, and 13*d*), a bucket mute 84 (see FIGS. 5, 7, 9-11, 12*a*. 12*b*, 13*a*, and 13*b*), and a plunger mute 82 (see FIGS. 6, 8, 14*a*, and 14*b*). By combining these functions, mute 10 may be more versatile and convenient than standard mutes. Further enhancing its convenient nature, mute 10 may unfold into a flat form or state 86 (see FIGS. 1-4, and 15-19) where it may be easily transported or used as an acoustic baffle 88 (see FIG. 15). Mute 10 may be intended as a versatile enhanced tool for professional musicians, the use of which may appeal to any brass-playing musician extending to the beginner levels.

Mute 10 may generally include body 12 and locking mechanism 18. These parts will be described in greater detail below.

Mute 10 may generally be formed by body 12. Body 12 may provide the overall shape, size and structure of mute 10. Body 12 may include or be made from a sheet of rollable material 14 configured to roll into cone shaped mute 16. Mute 10 may be made from a semi rigid material and can be used by folding into the form of a cone or as a semi-circle when unfolded. As examples, and clearly not limited thereto, body 12 of mute 10 can be made of leather, vinyl, two-layer vinyl, vinyl and cork, or the like, or combinations thereof. Different materials of body 12 may result in different characteristic tonal colors. Thus, body 12 of mute 10 may be designed out of different materials for various styles of music and artists. Mute 10 may be transported or stored in a flat form of body 12.

Referring specifically to FIGS. 1-4 and 16-19, body 12 may have substantially semi-circle shape 20 when in flat form or shape 86 that is configured to roll into cone shaped mute 16. Substantially semi-circle shape 20 of body 12 may have an outer diameter 22 when flat configured to create open end 24 of the cone shaped mute 16 when rolled into cone shaped mute 16. Open end 24 of the cone shaped mute 16 may be sized to match rim 25 of bell 26 of brass instrument 28. Open end 24 may be sized and shaped to fit any brass instruments or the like, including, but not limited to: a trumpet or a cornet; a French horn, a trombone, a baritone or a euphonium, a tuba or a sousaphone, the like, and/or combinations thereof.

In select embodiments, the substantially semi-circle shape 20 of the body 12 may have side 30 with cut-out 32. Cut-out 32 may be positioned approximate middle 34 of the side 30. The cut-out 32 may have inner diameter 36 when flat. Inner diameter 36 may be configured to make opening 38 at pointed end 40 of the cone shaped mute 16 when rolled into the cone shaped mute 16. The size and/or shape of opening 38 at pointed end 40 may be varied by changing the size and/or shape of cut-out 32 and inner diameter 36. The presence or non-presence of opening 38, and the size and shape of opening 38 at pointed end 40 may provide a different tonal characteristic to brass instrument 28 via mute 10.

In select embodiments, the substantially semi-circle shape 20 of the body 12 may have side 30 with top edge 42 and bottom edge 44. The top edge 42 may be configured to overlap with the bottom edge 44 for creating the cone shaped mute 16. In select embodiments, the top edge 42 may be angled with an angle 46 from the bottom edge 44 for creating the desired amount of overlap 52.

Locking mechanism 18 may be included with mute 10. Locking mechanism 18 may be for holding or locking body 12 as cone shape mute 16. As such, locking mechanism 18 may be configured to lock the rolled sheet of rollable material 14 as cone shaped mute 16. In select embodiments, the locking mechanism 18 may include top connector 48 and bottom connector 50. The top connector 48 may be positioned approximate the top edge 42. The bottom connector 50 may be positioned approximate the bottom edge 44. Wherein, when the body 12 may be rolled into the cone shaped mute 16 and the top edge 42 overlaps the bottom edge 44, the top connector 48 and the bottom connector 50 may be configured to lock together for securing the body 12 as the cone shaped mute 16.

Referring specifically to FIGS. 1-8, 11 and 14, in select embodiments of the locking mechanism 18, the top connector 48 and the bottom connector 50 may comprise snap connections 54. Snap connections 54 may be standard snap or button type connections for locking things together. Snap connections 54 may include a male and a female side on opposite edges (top and bottom edges 42 and 44). In select embodiments, as shown in the Figures (but clearly not limited thereto), the top connector 48 may comprise two top snap connections 56 positioned and spaced apart along the top edge 42, and the bottom connector 50 may comprise two corresponding bottom snap connections 58 positioned and spaced apart along the bottom edge 44 (or vice versa). Wherein, when the body 12 is rolled into the cone shaped mute 16 and the top edge 42 overlaps the bottom edge 44, the two top snap connections 56 of the top connector 48 and the two bottom corresponding snap connections 58 of the bottom connector 50 may be configured to lock together for securing the body 12 as the cone shaped mute 16. The top snap connections 56 may be male snap connectors and the bottom snap connections 58 may be female snap connectors, or vice versa, or combinations thereof.

Referring now to FIGS. 16-19, in other select embodiments of locking mechanism 18, the top connector 48 and the bottom connector 50 may comprise hook and loop type fasteners 60. Hook and loop type fasteners 60 may be standard hook and loop type fasteners for locking things together, like Velcro® or other similar materials. Hook and loop type fasteners 60 may include a hook side and a loop side on opposite edges (top and bottom edges 42 and 44). In select embodiments, as shown in the Figures, the top connector 48 may comprise two top hook or loop strips 62 positioned and spaced apart along and perpendicular to the top edge 42, and the bottom connector 5 may comprise two corresponding bottom hook or loop strips 64 positioned and spaced apart along and perpendicular to the bottom edge 44. As an example, the two top strips 62 may be hook strips and the two bottom strips 64 may be loop strips, or vice versa. Wherein, when the body 12 is rolled into the cone shaped mute 16 and the top edge 42 overlaps the bottom edge 44, the two top hook or loop strips 62 of the top connector 48 and the two corresponding bottom hook or loop strips 64 of the bottom connector 50 may be configured to lock together for securing the body 12 as the cone shaped mute 16.

At least one attachment arm 66 may be included with mute 10. Attachment arm 66 may be for securing open end 24 on rim 25 or adjacent bell 26 of brass instrument 28. Attachment arm 66 may be any configuration or shape, and/or may include any attachment means for securing open end 24 on rim 25 or adjacent bell 26. The attachment arm or arms 66 may be configured to hang the open end 24 of the cone shaped mute 16 from the rim 25 of the bell 26 of the brass instrument 28 for use as the bucket mute 84 or cup mute 68. Each of the at least one attachment arms 66 may include at least one protrusion 70 for hanging the open end 24 of the cone shaped mute 16 from the rim of the bell 26 of the brass instrument 28. As an example, and clearly not limited thereto, as shown in FIGS. 12 and 13, the at least one protrusion 70 of attachment arm(s) 66 may include a first protrusion 70*a*, and a second protrusion 70*b*, for hanging the top portion of open end 24 at two distances from bell 26. These two distances provide positions that are open and closed, and affect the tonal color of the instrument 28 by lesser (open position) or greater (closed position) degree of engagement of the mute 10. In select embodiments, the mute 10 may include two attachment arms 66 spaced apart along the top portion of the open end 24 of the cone shaped mute 16.

An adjustment arm 72 may be included with mute 10. Adjustment arm 72 may be for providing adjustability of the space 74 between the rim of the bell 26 and the open end 24 of the cone shaped mute 16. Adjustment arm 72 may be any configuration or shape, and/or include any type of adjustment mechanism for providing adjustability of the space 74 between the bell 26 and the open end 24 of the cone shaped mute 16. Adjustment arm 72 may comprise a plurality of slots 76 configured to receive the rim of the bell 26 of the brass instrument 28. As an example, and clearly not limited thereto, as shown in FIGS. 12 and 13, the plurality of slots 76 of adjustment arm 72 may include a first slot 76*a*, a second slot 76*b*, a third slot 76*c*, and a fourth slot 76*d*, for providing four different adjustment positions of the space 74. The adjustment arm 72 may thus be adjustable to four different positions in the form of open concavities meant to hold in place on the bottom of the rim of the bell 26 and ranging from open to closed. Whereby, the space 74 between the bell 26 and the open end 24 of the cone shaped mute 16 may be adjusted by placing the bell in the plurality of slots 76.

The attachment arm(s) 66 and/or the adjustment arm 72 may be made of and desirable material. In select embodiments, the attachment arm(s) 66 and/or the adjustment arm 72 may be made of rigid ABS plastic. In addition, the attachment arm(s) 66 and/or the adjustment arm 72 may be attached to the body 12 by any desired means. In select example embodiments, the attachment arm(s) 66 and/or the adjustment arm 72 may be attached to the body 12 of the mute 10 by means of break stem rivets (as shown in the Figures) or nuts and bolts.

Referring now specifically to FIGS. 12 and 13, in select embodiments of the rollable and adjustable mute 10 for brass instruments 28 described herein, the attachment arm(s) 66 may comprise two protrusions 70*a* (see FIG. 12) and 70*b* (see FIG. 13). As shown in these Figures, protrusion 70*a* provides a more open position between the top portion of mute 10 and the rim of the bell 26 (see FIGS. 12*a*, 12*b*, 12*c*, and 12*d*), and protrusion 70*b* provides a more closed position between the top portion of mute 10 and bell 26 (see FIGS. 13*a*, 13*b*, 13*c* and 13*d*). Still referring to these Figures, the adjustment arm 72 may comprise four slots 76*a*, 76*b*, 76*c*, and 76*d*, ranging from more closed between the bottom portion of mute 10 and bell 26 to more open. In this embodiment shown in the FIGS. 12 and 13, the cone shaped mute 16 may provide eight muting positions 78. FIG. 12*a* shows a first muting position 78*a* with the attachment arms 66 hanging from the first protrusion 70*a* and the adjustment arm positioned in first slot 76*a*. FIG. 12*b* shows a second muting position 78*b* with the attachment arms 66 hanging from the first protrusion 70*a* and the adjustment arm positioned in second slot 76*b*. FIG. 12*c* shows a third muting position 78*c* with the attachment arms 66 hanging from the first protrusion 70*a* and the adjustment arm positioned in third slot 76*c*. FIG. 12*d* shows a fourth muting position 78*d* with the attachment arms 66 hanging from the first protrusion 70*a* and the adjustment arm positioned in fourth slot 76*d*. FIG. 13*a* shows a fifth muting position 78*e* with the attachment arms 66 hanging from the second protrusion 70*b* and the adjustment arm positioned in first slot 76*a*. FIG. 13*b* shows a sixth muting position 78*f* with the attachment arms 66 hanging from the second protrusion 70*b* and the adjustment arm positioned in second slot 76*b*. FIG. 13*c* shows a seventh muting position 78*g* with the attachment arms 66 hanging from the second protrusion 70*b* and the adjustment arm positioned in third slot 76*c*. FIG. 13*d* shows an eighth muting position 78*h* with the attachment arms 66 hanging from the second protrusion 70*b* and the adjustment arm positioned in fourth slot 76*d*. Again, the tonal color is affected by the degree of engagement of the mute 10 with the rim of the bell 26 of brass instrument 28. The result is eight distinct tonal colors by the use of the different attachment arm and adjustment arm positions. In the more open positions, the tonal color may closely resemble that of a cup mute 68 (see FIGS. 12*c*, 12*d*, 13*c*, and 13*d*). As the mute 10 is more engaged in closed positions, the tonal color sounds more like the bucket mute 84 (see FIGS. 12*a*, 12*b*, 13*a*, and 13*b*). While in the folded cone position, the arms may be rotated 80 into the body so that mute may be handheld and used as a plunger type mute 82 (see FIGS. 14*a* and 14*b*).

Figure 14A:
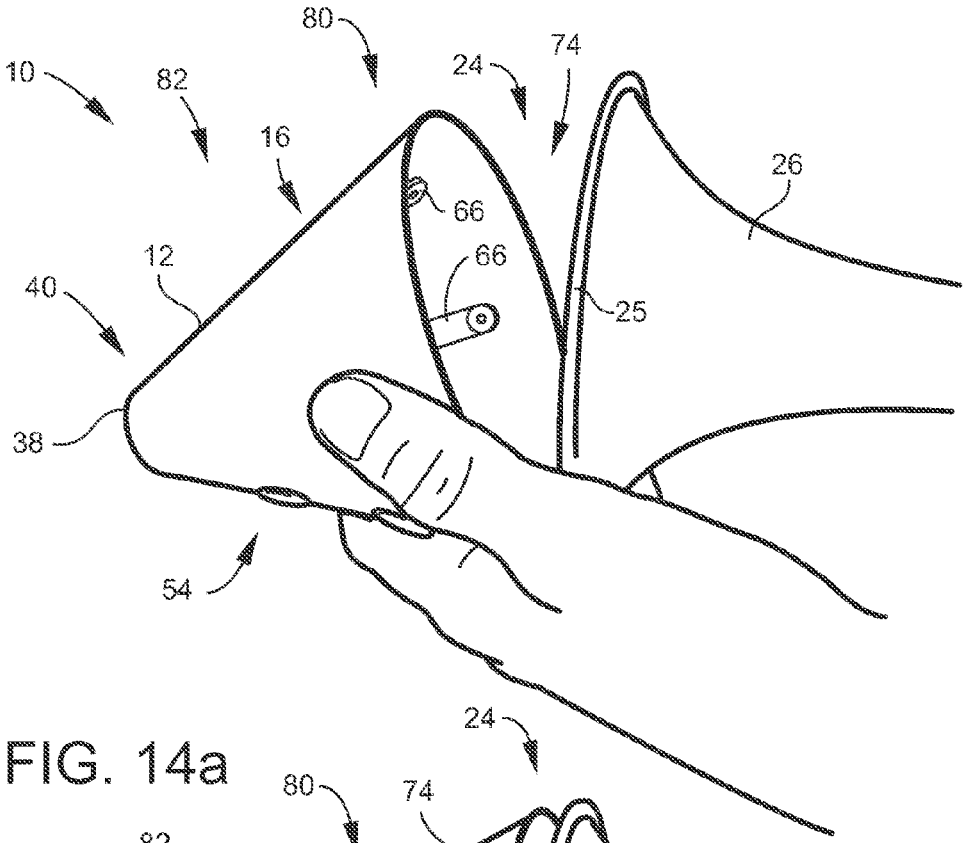
FIG. 14*a* is a perspective view of the mute from FIG. 6 being used as a plunger mute at the end of the bell of a brass instrument positioned in an opened position.
Figure 14B:
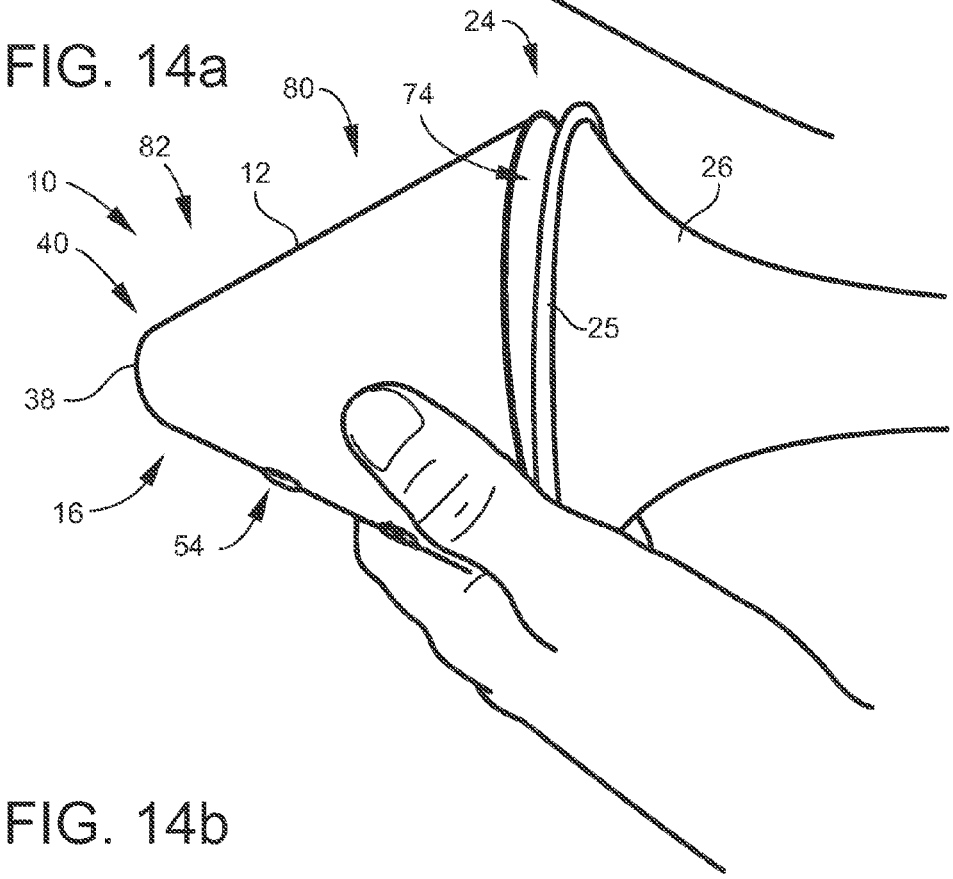
FIG. 14*b* is a perspective view of the mute from FIG. 14*a* being used as a plunger mute at the end of the bell of a brass instrument positioned in a closed position.

The attachment arm(s) 66 and/or the adjustment arm 72 may be rotatable 80 about body 12 of mute 10. This rotatable feature 80 may allow the attachment arm(s) 66 and the adjustment arm 72 to rotate for recessing the at least one attachment arm 66 and the adjustment arm 72 inside the cone shaped mute 16. As such, attachment arm(s) 66 and adjustment arm 72 may be extended outwards for use as the bucket mute 84 and/or cup mute 68. In addition, this rotation 80 of attachment arm(s) 66 and the adjustment arm 72 about body 12 of mute 10 may allow for the arms to be folded inside the cone shaped mute 16 for use as a plunger type mute 82. Referring specifically to FIGS. 14*a* and 14*b*, when the arms 66 and 72 are rotated inside cone shaped mute 16 the mute 10 may be manipulated with a user's hand from more open space 74 (see FIG. 14*a*) to more closed space 74 (see FIG. 14*b*) to manipulate the tone as a standard plunger type mute 82.

Figure 15:
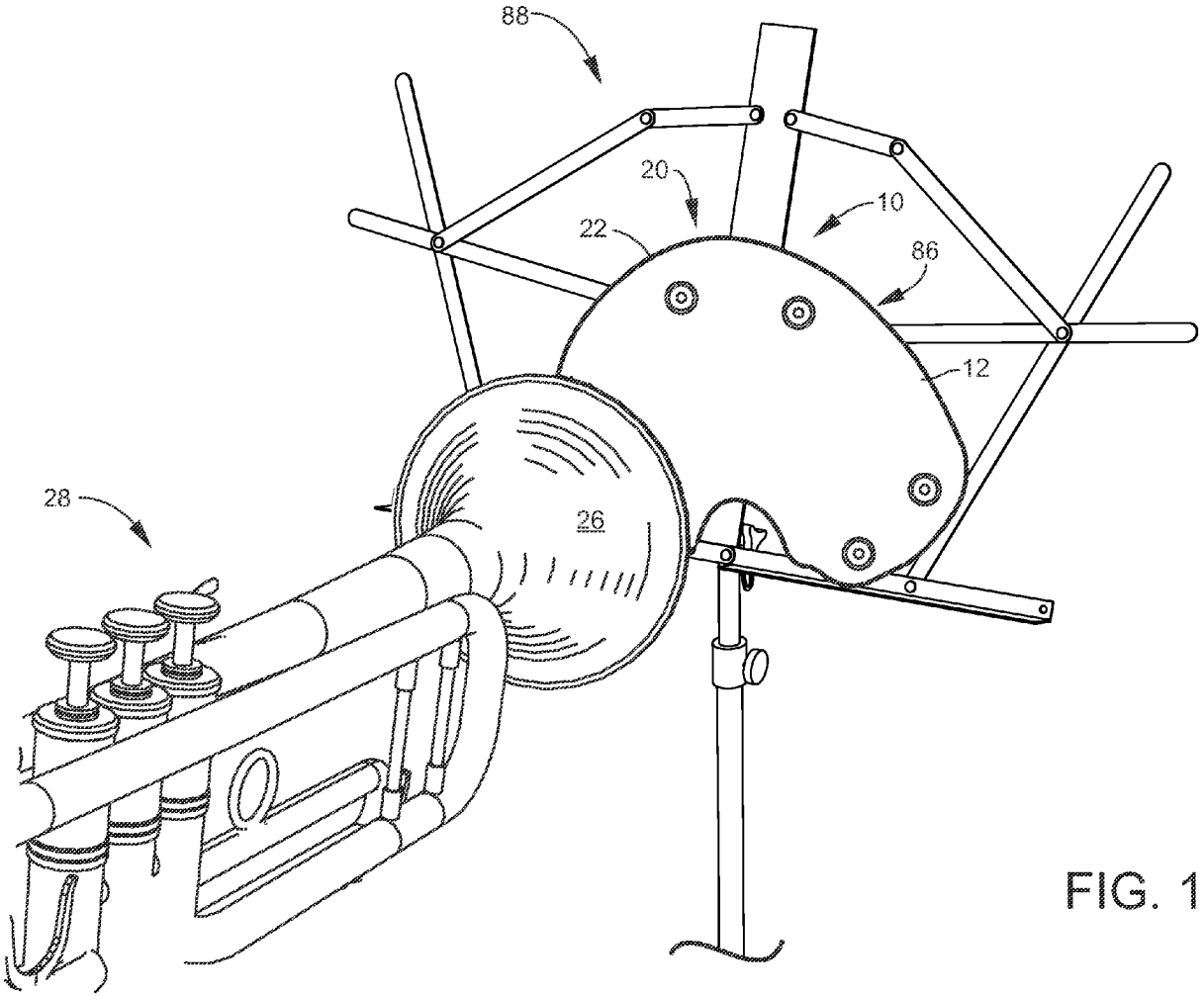
FIG. 15 is a perspective view of the mute from FIG. 4 set on a music stand and being used as an acoustic baffle for a brass instrument.
Figure 16:
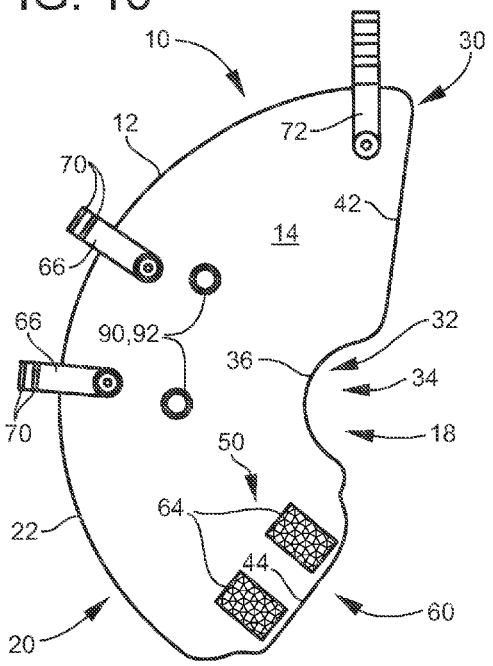
FIG. 16 is a top plane view of the instant rollable and adjustable mute for brass instruments according to one embodiment in a flattened or unrolled form with the attachment and adjustment arms rotated outwards with two vent holes and a hook and loop locking mechanism.
Figure 17:
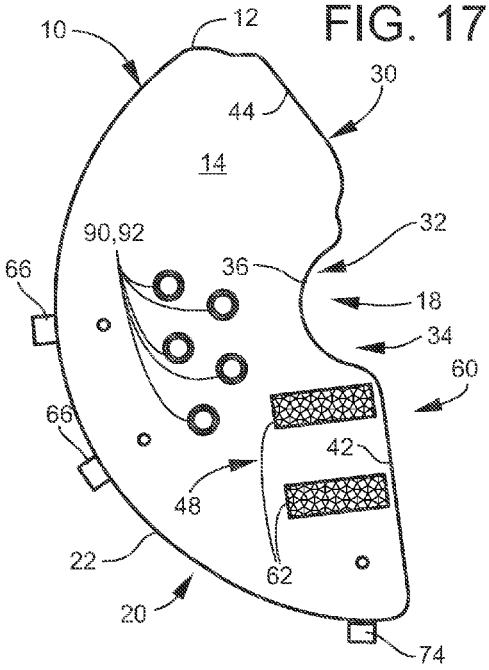
FIG. 17 is a back plane view of the instant rollable and adjustable mute for brass instruments according to one embodiment in a flattened or unrolled form with the attachment and adjustment arms rotated outwards with five vent holes and a hook and loop locking mechanism.
Figure 18:
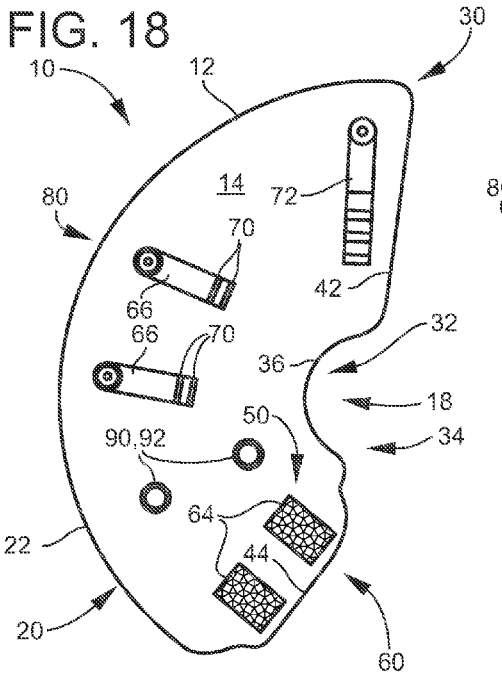
FIG. 18 is a top plane view of the instant rollable and adjustable mute for brass instruments according to one embodiment in a flattened or unrolled form with the attachment and adjustment arms rotated inwards with two vent holes and a hook and loop locking mechanism.
Figure 19:
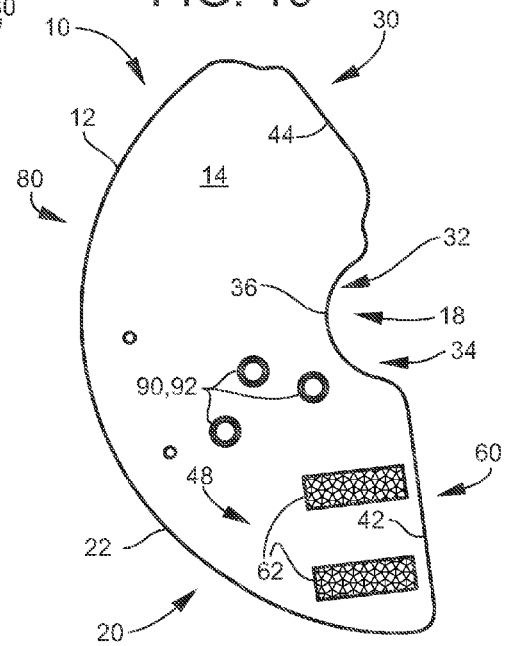
FIG. 19 is a back plane view of the instant rollable and adjustable mute for brass instruments according to one embodiment in a flattened or unrolled form with the attachment and adjustment arms rotated inwards with three vent holes and a hook and loop locking mechanism.

Referring now specifically to FIG. 15, another feature of the rollable and adjustable mute 10 for brass instruments 28 described herein may be that the body 12 may be positioned in flat position 86. As shown in the Figure, this flat position 86 may all mute 10 to be used as an acoustic baffle 88 for a brass instrument. As an example, the mute 10 may be in flat position 86 and positioned on a music stand (or other like device) and used as an acoustic baffle 88.

Referring now again specifically to FIGS. 16-19, at least one vent 90 may be included in mute 10 for brass instruments 28. Vent 90 may be included in mute 10 for providing various vents, slots, holes, or the like in mute 10 for creating various tonal characteristics. In select embodiments, each of the at least one vents 90 may be an eyelet hole 92 in the sheet of rollable material 14 of body 12. In select example embodiments, the at least one vent 90 may include, but is not limited to: two eyelet holes 92 positioned approximately vertical with one another in the sheet of rollable material 14 (see FIG. 16); two eyelet holes 92 positioned approximately horizontal with one another in the sheet of rollable material 14 (see FIG. 17); three eyelet holes 92 positioned offset with one another in the sheet of rollable material 14 (see FIG. 18); or five eyelet holes 92 positioned offset with one another in the sheet of rollable material 14 (see FIG. 19).

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A mute for a brass instrument comprising:

a body comprised of a sheet of rollable material configured to roll into a cone shaped mute;

a locking mechanism configured to lock the rolled sheet of rollable material as the cone shaped mute; and at least one attachment arm configured to hang an open end of the cone shaped mute from a rim of a bell of the brass instrument;

wherein the at least one attachment arm including at least one protrusion configured for hanging the open end of the cone shaped mute from the rim of the bell of the brass instrument, wherein the cone shaped mute is configured as a bucket mute or a cup mute.

2. The mute for of claim 1, wherein the mute may be transported or stored in a flat form of the body.

3. The mute of claim 1, wherein said body having a substantially semi-circle shape when flat configured to roll into the cone shaped mute;

the substantially semi-circle shape of the body having an outer diameter when flat configured to create an open end of the cone shaped mute when rolled into the cone shaped mute;

wherein the open end of the cone shaped mute being sized to match a rim of a bell of the brass instrument.

4. The mute of claim 3, wherein the substantially semi-circle shape of the body having a side with a cut-out approximate a middle of the side;

said cut-out having an inner diameter when flat configured to make an opening at a pointed end of the cone shaped mute when rolled into the cone shaped mute;

wherein the substantially semi-circle shape of the body having a side with a top edge configured to overlap with a bottom edge for creating the cone shaped mute, wherein the top edge is angled from the bottom edge.

5. The mute of claim 4, wherein the locking mechanism comprises:

a top connector approximate the top edge; and a bottom connector approximate the bottom edge;

wherein, when the body is rolled into the cone shaped mute and the top edge overlaps the bottom edge, the top connector and the bottom connector are configured to lock together for securing the body as the cone shaped mute.

6. The mute for of claim 5, wherein the top connector and the bottom connector comprise snap connections.

7. The mute of claim 6, wherein:

the top connector comprises two top snap connections positioned and spaced apart along the top edge; and the bottom connector comprises two bottom snap connections positioned and spaced apart along the bottom edge;

wherein, when the body is rolled into the cone shaped mute and the top edge overlaps the bottom edge, the two snap connections of the top connector and the two snap connections of the bottom connector are configured to lock together for securing the body as the cone shaped mute.

8. The mute of claim 5, wherein the top connector and the bottom connector comprise hook and loop type fasteners.

9. The mute of claim 8, wherein:

the top connector comprises two top hook or loop strips positioned and spaced apart along and perpendicular to the top edge; and the bottom connector comprises two corresponding bottom hook or loop strips positioned and spaced apart along and perpendicular to the bottom edge;

wherein, when the body is rolled into the cone shaped mute and the top edge overlaps the bottom edge, the two top hook or loop strips of the top connector and the two corresponding bottom hook or loop strips of the bottom connector are configured to lock together for securing the body as the cone shaped mute.

10. The mute of claim 1 comprising two attachment arms spaced apart along a top portion of the open end of the cone shaped mute.

11. The mute of claim 1 further comprising an adjustment arm configured to adjust space between the bell and the open end of the cone shaped mute;

wherein the adjustment arm comprising a plurality of slots configured to receive the rim of the bell of the brass instrument, the space between the bell and the open end of the cone shaped mute is configured to be adjusted by placing the rim of the bell in the plurality of slots.

12. The mute of claim 11, wherein:

each of the at least one attachment arms comprising two protrusions; and the adjustment arm comprising four slots;

the cone shaped mute provides eight muting positions.

13. The mute of claim 11, wherein each of the at least one attachment arms and the adjustment arm are configured to rotate to recess the at least one attachment arm and the adjustment arm inside the cone shaped mute, wherein the cone shaped mute is configured as a plunger mute.

14. The mute of claim 1, wherein the body may be positioned in a flat position for use as an acoustic baffle for a brass instrument.

15. The mute of claim 1, wherein the body including at least one vent, each of the at least one vents being an eyelet hole in the sheet of rollable material.

16. The mute of claim 15, wherein the body including:

two eyelet holes positioned approximately vertical with one another in the sheet of rollable material;

two eyelet holes positioned approximately horizontal with one another in the sheet of rollable material;

three eyelet holes positioned offset with one another in the sheet of rollable material; or five eyelet holes positioned offset with one another in the sheet of rollable material.

17. A mute for a brass instrument comprising:

at least one attachment arm configured to hang an open end of the mute from a rim of a bell of the brass instrument, wherein the mute is configured as a bucket mute or a cup mute, each of the at least one attachment arms including two protrusions configured to hang the open end of the mute from the rim of the bell of the brass instrument at two positions; and an adjustment arm comprising four slots configured to receive the rim of the bell of the brass instrument, a space between the bell and the open end of the mute is configured to be adjusted in four positions by placing the rim of the bell in the four slots;

the at least one attachment arm with two protrusions and the adjustment arm with four slots provides eight muting positions for the mute.

18. The mute of claim 17, wherein the at least one attachment arm and the adjustment arm are configured to rotate to recess the at least one attachment arm and the adjustment arm inside the mute, wherein the mute is configured as a plunger mute.

19. A mute for a brass instrument comprising:

at least one attachment arm configured to hang an open end of the mute from a rim of a bell of the brass instrument, wherein the mute is configured as a bucket mute or a cup mute; and an adjustment arm comprising at least one slot configured to receive the rim of the bell of the brass instrument, a space between the bell and the open end of the mute is configured to be set by placing the rim of the bell in the at least one slot;

wherein, the at least one attachment arm and the adjustment arm are configured to rotate to recess the at least one attachment arm and the adjustment arm inside the mute, wherein the mute is configured as a plunger mute.

* * * * *